United States Patent [19]

Ragland, Jr., deceased et al.

[11] Patent Number: 4,806,817

[45] Date of Patent: Feb. 21, 1989

[54] FILAMENT SUPPORTING MULTI-PLANAR WIRE INSERT FOR ELECTRIC INCANDESCENT LAMP

[75] Inventors: Owtis J. Ragland, Jr., deceased, late of Winchester, Ky., by Susan Ragland, administratrix; Arnold E. Westlund, Jr., Winchester, Ky.; Paul B. Reynolds; Stuart K. Denham, both of Waldoboro, Me.

[73] Assignee: GTE Products Corporation, Danvers, Mass.

[21] Appl. No.: 211,143

[22] Filed: Jun. 22, 1988

Related U.S. Application Data

[63] Continuation of Ser. No. 904,422, Sep. 8, 1986, abandoned.

[51] Int. Cl.[4] ..... H01K 1/88

[52] U.S. Cl. ..... 313/279; 313/271

[58] Field of Search ..... 313/271, 278, 279, 318, 313/579

[56] References Cited

U.S. PATENT DOCUMENTS

| | | | |
|---|---|---|---|
| 3,403,280 | 9/1968 | Cardwell, Jr. | 313/271 |
| 4,243,907 | 1/1981 | Kohl et al. | 313/318 |
| 4,553,066 | 11/1985 | Fields et al. | 313/579 |
| 4,568,854 | 2/1986 | Westlund, Jr. et al. | 313/579 |

*Primary Examiner*—David K. Moore
*Assistant Examiner*—T. Salindong
*Attorney, Agent, or Firm*—Lawrence R. Fraley; Edward J. Coleman

[57] ABSTRACT

A multi-planar, one-piece wire insert for supporting a coil filament body in an electric incadescent lamp in which the wire insert includes a top leg disposed in a plane out of the main plane of the insert so as to permit the coil filament body, as wound, to fit (match) the insert directly without requiring alteration to the ends of the coil filament body and/or changing of the wound coil geometry.

19 Claims, 1 Drawing Sheet

Fig. 1A
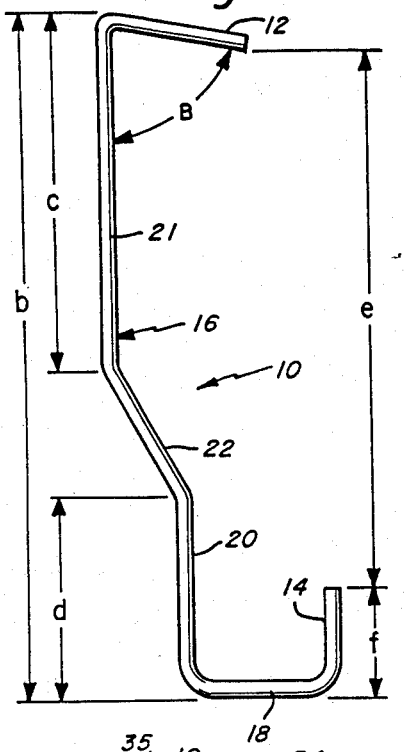
Fig. 2A
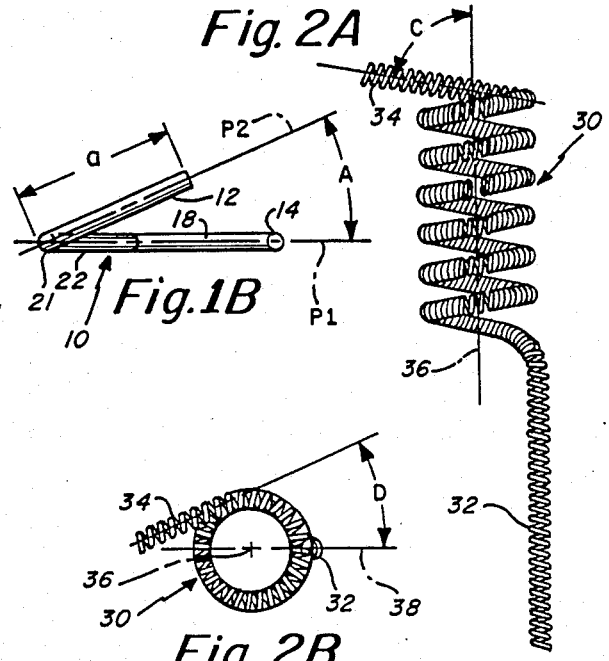
Fig. 1B
Fig. 2B
Fig. 3A
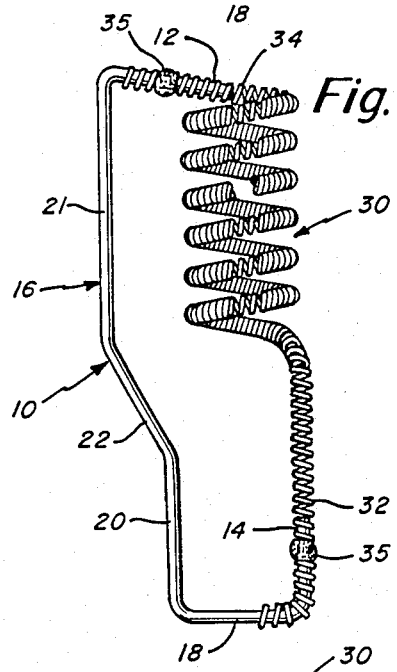
Fig. 3B
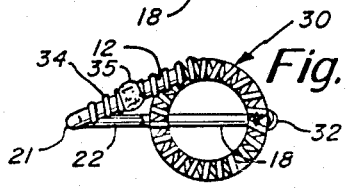
Fig. 4
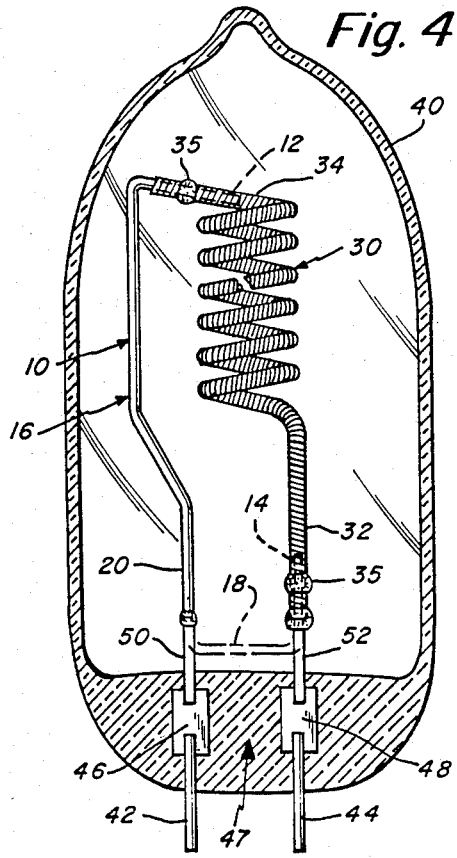

FILAMENT SUPPORTING MULTI-PLANAR WIRE INSERT FOR ELECTRIC INCANDESCENT LAMP

This application is a continuation of application Ser. No. 904,422, filed Sept. 8, 1986, now abandoned.

TECHNICAL FIELD

The present invention relates in general to a filament-supporting wire insert for use in an electric incandescent lamp such as a tungsten halogen lamp. More particularly, the invention pertains to a one-piece, multi-planar wire insert adapted to have a coiled filament body fixed thereto without causing distortion of the body.

BACKGROUND

There presently exist a variety of wire inserts for supporting coiled filament bodies in an electric incandescent lamp. See, by way of example, U.S. Pat. No. 3,403,280 to Cardwell for one form of filament support that is of relatively complex construction. The common state-of-art insert is mono-plane in geometry.

One drawback associated with a mono-plane insert relates to the need to form, usually by hand, one end of the coiled filament body so that it conforms with the geometry of the mono-plane insert. There is thus a labor step required in forming the coil end to conform it to the insert configuration. Furthermore, the forming of the coil body causes some distortion thereof that causes some degradation in lamp operating quality. By the term coil, when used singularly herein, is thus meant to define a coiled coil structure wherein the structure (a wire) is originally coiled to form an initial configuration (i.e., linear) and this element is thereafter coiled again to form a second, different configuration (i.e., as shown in FIG. 2A of the drawings).

As indicated previously, there are a variety of configurations of mono-plane inserts for incandescent coiled coils. One industry standard is referred to as the "shepherd's crook" insert, so named for the bend at the top of the insert. For one thing, this bend may cause a problem by engaging the inner surface of the lamp envelope at the dome portion thereof, in turn causing a jamming of the coil during assembly. Secondly, the bend at the top of the insert means that the coil body has to be formed thereto and thus undesirably distorted. Also, the "shepherd's crook" is not well adapted to the fabrication of miniature sized lamps. For some lamp designs employing reflectors, the envelope has had to be elongated to compensate for the "shepherd's crook" insert design. This thus makes it more difficult to optimize miniaturization of the lamp.

Another form of standard insert is one having straight, vertically-disposed legs both at the top and bottom thereof. This insert is also mono-plane and requires forming, thus distorting the coil body. There is also a further configuration of insert in which the standard straight leg insert has a ninety degree bend at the top at the long (upper) side of the insert. Again, this form of insert causes a significant deformation in the top turns of the coil body.

It is, believed, therefore, that an insert capable of overcoming the aformentioned disadvantages of known such components would constitute a significant advancement in the art.

DISCLOSURE OF THE INVENTION

Accordingly, it is an object of the present invention to provide an improved coiled coil filament body insert for use in an electric incandescent lamp in which the top section of the insert is configured to permit the coiled coil body, as wound, to directly fit the insert without requiring adjustment or forming of the end or ends of the body.

Another object of the present invention is to provide an improved one-piece wire insert (filament support) for use in an electric incandescent lamp in which the coiled coil body is fit (attached) to the insert without altering or distorting the wound coil geometry.

A further object of the present invention is to provide an improved coiled coil filament body insert, preferably constructed of tungsten, which enables fitting the coil to the insert in the exact coil configuration that the coil possessed as it exited the automatic coiling machine of the type typically used in the manufacture of filament bodies of the type described herein.

Still another object of the present invention is to provide an improved coiled coil filament body insert that is constructed to enable a substantial reduction in assembly cost thereof. This is realized in accordance with the present invention by elimination of the heretofore needed requirement for using skilled labor to hand or machine form one end of the coil body subsequent to final formation thereof (after leaving the automatic coiling machine).

Another object of the present invention is to provide an improvement in the stabilization of the coil and insert assembled structure, thereby minimizing and substantially eliminating coil distortion.

A further object of the present invention is to provide an improved one-piece insert that eliminates the problems previously mentioned with regard to many "standard" inserts, in particular those of the "shepherd's crook" type, including the elimination of coil distortion.

Still a further object of the present invention is to provide an improved one-piece insert that is configured to facilitate construction of more miniaturized lamps of the type described herein.

Another object of the present invention is to provide a wire insert of one-piece construction in which the finished insert and coil have improved cosmetic appearance brought about primarily because the coil has not been deformed by securement to the insert.

A further object of the present invention is to provide an improved wire insert of one-piece construction that is employed to position and hold the coiled coil filament body of an incandescent lamp in a fixed and correct geometric position, maintaining this wound coil geometry even after fitting onto the insert to thus provide a lamp having uniform output and a longer life than lamps not so treated.

Another object of the present invention is to provide an improved wire insert for engagement with a coiled coil filament body, the combination providing improved overall finished lamp quality and uniformity.

In accordance with one aspect of the invention, there is provided herein an improved multi-planar wire insert for supporting a coiled coil (hereinafter coil) filament body and in particular for supporting an electric incandescent lamp coil. The coil body has opposite upper and lower coiled ends, while the wire insert has a top leg and bottom leg intercoupled by an intermediate portion adapted for extending substantially vertically and in parallel to the axis of the coil body. The wire insert bottom leg supports the lower coil end and is disposed, along with the intermediate portion, in a first plane, which first plane also passes through the coil body axis and lower leg in the assembled position of the coil body and insert. The wire insert top leg supports the upper coil end and is disposed in a second plane extending at an acute angle to the first plane such that the wire insert supports the coil body ends without deformation to the coil body (i.e., when secured to the insert). The displacement of the top leg out of the main (first) plane of the insert allows the coil body, as wound, to fit the insert without adjusting either end of the coil body and/or changing the wound coil geometry.

In a preferred embodiment of the present invention the wire insert and coil body are both constructed of tungsten and the wire insert is of one-piece construction. The wire insert supports the coil body ends by inserting the legs of the insert into the coil body ends. The insert's bottom leg is relatively short and extends vertically in parallel to the coil body's central axis. The insert's top leg extends from the insert's intermediate portion toward the coil body at an acute angle (close to normal) to said intermediate portion. The coil body's lower end extends vertically downward to match and engage (slide over) the insert's bottom leg without coil body alteration (deformation). Similarly, the coil body upper end extends tangentially from the coil body to match and engage the insert's angularly depending top leg, also without coil body alteration.

BRIEF DESCRIPTION OF THE DRAWINGS

FIG. 1A is a front elevational view of the multi-planar wire insert of the present invention in accordance with a preferred embodiment thereof;

FIG. 1B is a top plan view of the multi-planar wire insert of FIG. 1A, showing in particular the separate planes P1 and P2;

FIG. 2A is a front elevational view of a coil filament body including coil ends adapted for use with the insert of FIGS. 1A and 1B;

FIG. 2B is a top plan view of the coil body of FIG. 2A;

FIG. 3A is a front elevational view illustrating the coil filament body of FIG. 2A as supported by the insert depicted in FIG. 1A;

FIG. 3B is a top plan view of the insert and coil body assembly of FIG. 3A; and

FIG. 4 shows the coil filament and insert assembly as supported within an electric incandescent lamp (e.g., of the tungsten halogen variety).

BEST MODE FOR CARRYING OUT THE INVENTION

For a better understanding of the present invention together with other and further objects, advantages and capabilities thereof, reference is made to the following disclosure and appended claims in connection with the above-described drawings.

Reference is now made to the drawings that illustrate a multi-planar, one-piece wire insert 10 for incandescent lamp filament coil bodies. Insert 10, as well as the coil body (30), are preferably constructed of tungsten. FIGS. 1A and 1B illustrate the insert taken alone, while FIGS. 2A and 2B illustrate the coil filament body in a configuration as it comes directly off of a coiling machine typical of those used in the lamp manufacturing art. FIGS. 3A and 3B illustrate the combination of insert and coil body (the body secured to the insert) while FIG. 4 shows the combination as used in an electric incandescent lamp.

Referring now with greater particularity to FIGS. 1A and 1B, the one-piece insert 10 includes a top leg 12, a bottom leg 14 and an intermediate portion 16 that in turn is comprised of a substantially horizontal segment 18, vertical segments 20 and 21, and an angular segment 22 which interconnects segments 20 and 21. FIG. 1A shows the leg 14 as being a relatively short leg (compared to leg 12) that extends substantially vertically (upward). The upper leg 12 of the insert is disposed at almost a right angle (as viewed in FIG. 1A) to the vertical segment 21 of the intermediate portion of the insert. FIG. 1A shows the preferred angle (B) between the leg 12 and the segment 21. Angle B is preferably within the range of about 70° to about 78°. In one example, angle B was 74°.

FIG. 1B illustrates the multi-planar aspect of the wire insert 10, which aspect represents a significant feature of the invention. The main plane of the insert is identified in FIG. 1B as the plane P1. The shorter leg 14, along with the entire intermediate portion (including segments 18, 20, 21 and 22), all fall generally within plane P1. The top leg 12, on the other hand, extends angularly as viewed from the top of the insert along a second plane indentified in FIG. 1B as plane P2. The angle between the planes P1 and P2 is identified in FIG. 1B as the angle A, which angle is preferably within the range of about 25° to about 35°. In one example (the same mentioned above), angle A was 31°.

In connection with the insert illustrated in FIGS. 1A and 1B, the following are representative dimensions thereof:

In connection with the coil filament body configuration, reference is made to FIGS. 2A and 2B. As shown herein, coil body 30 is comprised of a coiled coil similar wire element. The coiled coil illustrated in FIGS. 2A and 2B includes a main coil body 30 having opposite coil ends including a downwardly projecting lower end 32 and an angularly disposed upper end 34. It is noted that the lower end 32 is disposed in a substantially vertical orientation in parallel to the main coil body's central axis 36. Depending upon the particular application, the lower leg 32 may be provided in different lengths. The upper coil end 34 extends tangentially from the main coil body as clearly illustrated in FIG. 2B and is furthermore disposed at an angle (C) to central axis 36 (FIG. 2A). As also shown in FIG. 2B, angle D represents the angle in the top plan view between the upper coil end 34 and the central coil plane 38 that passes through the axis 36 and the lower coil end 32. The plane 38 illustrated in FIG. 2B thus corresponds to the plane P1 illustrated in FIG. 1B.

Reference is now directed to FIGS. 3A and 3B for an illustration of the assembly of the present invention. This assembly to be eventually positioned within the envelope of an electric lamp. It is noted that the shorter lower leg 14 of the insert has been inserted into the lower coil end 32. In FIG. 3A the lower coil end 32 is shown extending over the insert leg 14 and slightly bent around the corner to extend partially onto segment 18. However, in practice, coil end 32 need only extend sufficiently over leg 14 to enable a weld to occur. Thus, such bending is not required but may be desired to facilitate handling of the assembly during the manufacturing process prior to final coil securement. In this connection, two welds (35), each at one end of the coiled coil, are used. FIGS. 3A and 3B also illustrate the top leg 12 of the insert slidably engaging the upper coil end 34 prior to such securement.

FIGS. 2A and 2B illustrate the coiled coil as it is fabricated directly from the coil winding machine used to produce this component. When the coil body comes off the coil winding machine, it has the projecting lower end 32 extending vertically (as shown) and also has the upper coil end 34 disposed in the manner illustrated in FIGS. 2A and 2B. The coil end 34 extends tangentially as illustrated in FIG. 2B and is also disposed at the above-mentioned angle (C) to axis 36.

In accordance with the teachings provided herein, there has thus been provided a multi-planar one piece insert that, in particular, possesses a fixed configuration so as to permit the coil to be used directly (secured to the insert) as it comes off the automatic winding machine. This feature eliminates the need for added labor to form either of the coil ends and furthermore enables the coil body, as wound, to be maintained in a preestablished, desired geometry (illustrated). In this way, a large part of the finished coil cost is eliminated and the finished coil is better geometrically because it has not been distorted by such forming as in the past been considered necessary.

In this regard, the direct insertion without coil deformation is possible by providing the top leg of the insert out of the plane of the remainder of the insert as illustrated by the plane P2 in FIG. 1B. Secondly, the leg 112 is disposed not at a right angle to the segment 21 but preferably at the defined acute angle (B) close to but less than a 90° angle (i.e., 74°). Further in this regard, in order to provide proper matching of coil and insert, the angle B in FIG. 1A is essentially the same as angle C in FIG. 2A. Also, to provide proper (precise) matching and insertion between coil and insert, the angle A depicted in FIG. 1B between the planes P1 and P2 is the same as angle D referred to previously in connection with FIG. 2B.

With reference to FIG. 4, there is shown the filament coil and insert assembly of the present invention as employed in an electric incandescent lamp. In this regard, FIG. 4 illustrates the lamp envelope 40. On the assumption that the lamp is, for example, a tungsten halogen lamp, then the envelope is filled with a known atmosphere including a halogen gas. FIG. 4 also shows the outer leads 42 and 44 typically used in single filament lamps of this type. These outer leads may be constructed of molybdenum and are respectively connected to thin molybdenum foils 46 and 48 which are in turn connected to inner leads 50 and 52 which may form part of or are separate members secured to insert 10. For examples of typical lamps having a press seal and using molybdenum foils in the seal ends thereof, reference is made to U.S. Pat. Nos. 4,243,907, 4,553,066 and 4,568,854, the teachings of which are thus incorporated herein by reference.

In the assembly of the lamp, once the aforedefined welding has occurred to secure coil 30 to insert 10, inner leads 50 and 52, being secured to foils 46 and 48, are next attached to the insert. One of these inner leads (which may both be of molybdenum if not part of the insert itself) may be properly welded to the insert segment 20 while the other lead (52) may be secured to the coil end 32. FIG. 4 also shows the segment 18 in dotted outline to indicate the removal thereof. Thus, after the inner leads 50 and 52 have been attached, respectively, to the insert and coil body, then the closed loop formed thereby is opened by removing at least a portion of the segment 18 of the insert. Also, in the formation of the lamp, the molybdenum foils 46 and 48 are of course disposed in the envlope 40 in the press seal area as illustrated at 47. This sealing operation occurs after the aforedefined welding (attachment) and cutting (of segment 18) procedures. The preferred embodiment is to have leg 14 and segment 20 of insert 10 directly connected (e.g., welded), respectively, to the uppermost ends of molybdenum foils 46 and 48. Portions of both the inner leads (if used) and outer leads are retained in the seal 47, as is the entire portion of each foil. If the inner leads are not used, then portions of the aforesaid leg (14) and segment (20) are sealed within press seal area 47. Subsequent to such insert and coil placement and formation of the singular press seal, the desired atmosphere (i.e., halogen) is introduced into the envelope through the remaining open end after which this end is sealed (i.e., tipped) using an operation known in the art.

While there have been shown and described what are at present considered the preferred embodiments of the invention, it will be obvious to those skilled in the art that various changes and modifications may be made therein without departing from the scope of the invention as defined by the appended claims. For example, although only a singular filament lamp has been illustrated herein, it is understood that the teachings of the invention are also clearly applicable to lamps possessing two (or more) coiled filament bodies within the envelopes thereof.

What is claimed is:

1. A wire insert for supporting a coil filament body secured thereto and said coil filament having a central axis and opposite upper and lower coil ends, the combination of wire insert and coil filament body adapted for use in an electric incandescent lamp, said wire insert having a top leg and bottom leg intercoupled by an intermediate portion extending substantially in parallel to said central axis of said coil filament body, said bottom leg of said wire insert, along with said intermediate portion, in a first plane, said top leg of said wire insert supporting said lower coil end and disposed, along with said intermediate portion in said first plane, said top leg of said wire insert suporting said upper coil end and disposed in a second plane extending at an acute angle to said first plane such that said wire insert supports said coil filament body ends without deformation of said coil filament body, said wire insert being formed of a single piece of wire to constitute a one-piece construction and having said coil filament body secured thereto prior to positioning and use within said incandescent lamp.

2. The wire insert according to claim 1 wherein said bottom leg of said wire insert is a relatively short leg that extends vertically and in parallel to said central axis of said coil filament body.

3. The wire insert according to claim 2 wherein said top leg of said wire insert extends from said intermediate portion of said wire insert toward said coil filament body and at an acute angle substantially close to normal to said intermediate portion.

4. The wire insert according to claim 3 wherein said lower end of said coil filament body extends substantially vertically to match and engage said bottom leg of said wire insert without coil filament body alteration.

5. The wire insert according to claim 4 wherein said upper end of said coil filament body extends tangentially from said coil filament body to match and engage said insert top leg of said wire insert without coil filament body alteration.

6. The wire insert according to claim 3 wherein said intermediate portion of said wire insert includes a top vertical segment and a bottom vertical segment intercoupled by an angled segment so that the top vertical segment is offset and disposed farther from said axis of said coil filament body than said bottom vertical segment.

7. The wire insert according to claim 6 wherein said acute angle between said top leg of said wire insert and said intermediate portion is within the range of from about 70° to about 78°.

8. The wire insert according to claim 7 wherein said acute angle between said first and second planes is within the range of about 25° to about 35°.

9. The wire insert according to claim 1 wherein both said wire insert and said coil body are comprised of tungsten.

10. A wire insert according to claim 1 wherein said coil filament body comprises a coiled coil, singular wire member.

11. The wire insert according to claim 1 wherein said wire insert supports said coil filament body ends by having the legs of said wire insert inserted within said coil body ends.

12. The wire insert according to claim 1 wherein said intermediate portion of said insert includes a top vertically extending segment, said top leg of said insert extending at an acute angle to said top vertically extending segment.

13. The wire insert according to claim 12 wherein said acute angle between said top leg of said wire insert and said vertically extending segment is close to normal but less than 90°.

14. The wire insert according to claim 13 wherein said acute angle between said top leg and said top vertically extending segment is within the range of about 70° to about 78°.

15. The wire insert according to claim 14 wherein said acute angle between said top leg and said top vertically extending segment is 74°.

16. The wire insert according to claim 13 wherein said coil filament body upper end extends angularly to said central axis of said coil filament body at an acute angle.

17. The wire insert according to claim 16 wherein said acute angle between said top leg of said insert and said top vertically extending segment and said acute angle between said coil filament body upper end and said central axis are substantially the same to facilitate matching said coil filament body to said wire insert prior to securement therebetween.

18. The wire insert according to claim 17 wherein said coil filament body upper end also extends tangentially from said coil filament body at an acute angle measured between said top leg and said first plane.

19. The wire insert according to claim 18 wherein said acute angle between said top leg and said first plane and said acute angle between said first and second planes are subsantially the same to facilitate matching said coil filament body to said wire insert prior to securement therebetween.

* * * * *